US009046030B2

(12) United States Patent
Kawaguchi et al.

(10) Patent No.: US 9,046,030 B2
(45) Date of Patent: Jun. 2, 2015

(54) AIR-COOLED ENGINE FOR WORKING MACHINE

(71) Applicant: HONDA MOTOR CO., LTD., Tokyo (JP)

(72) Inventors: Noboru Kawaguchi, Wako (JP); Toshiyuki Matsuda, Wako (JP); Eishi Sogo, Wako (JP); Teruyuki Saitoh, Wako (JP); Shota Gomibuchi, Wako (JP); Atsushi Maruyama, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/247,460

(22) Filed: Apr. 8, 2014

(65) Prior Publication Data

US 2014/0305107 A1 Oct. 16, 2014

(30) Foreign Application Priority Data

Apr. 12, 2013 (JP) ..... 2013-083725

(51) Int. Cl.

| | |
|---|---|
| ***F01N 3/02*** | (2006.01) |
| ***F01P 5/06*** | (2006.01) |
| ***F01N 3/05*** | (2006.01) |
| ***F02B 63/02*** | (2006.01) |
| ***F01N 13/00*** | (2010.01) |
| ***F01N 1/00*** | (2006.01) |
| ***F01P 1/06*** | (2006.01) |

(52) U.S. Cl.

CPC ... *F01P 5/06* (2013.01); *F01N 3/05* (2013.01); *F02B 63/02* (2013.01); *F01N 13/002* (2013.01); *F01N 1/00* (2013.01); *F01N 2260/022* (2013.01); *F01N 2590/06* (2013.01); *F01P 1/06* (2013.01)

(58) Field of Classification Search

CPC ..... F01N 13/002; F01N 1/00; F01N 3/05; F01N 2590/06; F01N 2260/022; F02B 63/02; F01P 5/06

USPC ..... 60/320

See application file for complete search history.

(56) References Cited

U.S. PATENT DOCUMENTS

| | | | | |
|---|---|---|---|---|
| 5,284,115 | A * | 2/1994 | Imanishi et al. | 123/41.7 |
| 5,383,427 | A * | 1/1995 | Tuggle et al. | 123/51 BA |
| 5,950,578 | A * | 9/1999 | Hirano et al. | 123/41.65 |
| 6,530,355 | B2 * | 3/2003 | Ito et al. | 123/196 R |
| 2003/0154934 | A1 * | 8/2003 | Nakamizo et al. | 123/41.56 |
| 2005/0061265 | A1 * | 3/2005 | Yuasa et al. | 123/41.7 |
| 2008/0048509 | A1 * | 2/2008 | Murakami et al. | 310/51 |
| 2012/0097119 | A1 * | 4/2012 | Yano et al. | 123/41.65 |

FOREIGN PATENT DOCUMENTS

| | | | |
|---|---|---|---|
| JP | 2002-363915 | A | 12/2002 |
| JP | 4532021 | B2 | 8/2010 |

* cited by examiner

*Primary Examiner* — Jason Shanske

(74) *Attorney, Agent, or Firm* — Westerman, Hattori, Daniels & Adrian, LLP

(57) ABSTRACT

An air-cooled engine for a working machine includes a fan cover, a muffler protector, and an insulator. The fan cover has a guide opening for guiding a cooling air toward an exhaust muffler. The muffler protector has air discharge holes for discharging the cooling air, which has been introduced through the guide opening into a guide passage, in a direction away from the working machine. The insulator has a deflector section bent toward a carburetor so that the cooling air having passed through another guide passage between the insulator and cylinder barrel is guided by the deflector section in a direction away from the working machine.

6 Claims, 12 Drawing Sheets

AIR-COOLED ENGINE FOR WORKING MACHINE

TECHNICAL FIELD

The present disclosure relates to an air-cooled engine adapted to be mounted to the body of a working machine for driving the working machine and configured to guide a cooling air fed from a cooling fan toward an exhaust muffler and a carburetor of the engine.

BACKGROUND ART

Air-cooled engines for working machines are generally configured such that while the engine is running, a cooling fan is rotated to draw outside air into a cover and guide the air as a cooling air within the cover in such a manner as to suppress temperature rise of a cylinder barrel (cylinder block), an exhaust muffler and a carburetor. The cooling air, having cooled the cylinder barrel, exhaust muffler and carburetor, is discharged from an outlet opening of the cover to the outside. A typical example of such air-cooled engines is disclosed in, for example, Japanese Patent No. 4532021 corresponding to Japanese Patent Application Laid-open Publication (JP-A) No. 2002-363915.

In one form of application, the air-cooled engine for working machines is mounted to a rammer device as a working machine. While the rammer (working machine) is in use, it may occur that a cooling air, which has been discharged from an outlet opening of a cover, hits on a part of the rammer device and reflects therefrom back to the outlet opening of the cover. The reflected cooling air will deteriorate the cooling efficiency of the air-cooled engine because the cooling air used for suppressing temperature rise of a cylinder barrel, an exhaust muffler, and a carburetor is relatively hot.

SUMMARY

It is, therefore, preferable to provide an air-cooled engine which is capable of properly suppressing temperature rise of a cylinder barrel, an exhaust muffler, and a carburetor.

According to one aspect of the present disclosure, there is provided an air-cooled engine for a working machine, comprising: a crankshaft having a first end adapted to be connected to the working machine, and a second end opposite to the first end; a cylinder barrel having a first side surface that faces in a direction perpendicular to an axis of the crankshaft, and a second side surface opposite to the first side surface; an exhaust muffler provided on the first side surface of the cylinder barrel; a carburetor provided on the second side surface of the cylinder barrel; a cooling fan connected to the second end of the crankshaft for rotation therewith; a fan cover that covers the cooling fan in such a manner as to guide a cooling air fed from the cooling fan toward the exhaust muffler and the carburetor in a bifurcated manner, the fan cover having a guide opening for allowing the passage therethrough of a part of the cooling air guided toward the exhaust muffler; a muffler protector that covers the guide opening of the fan cover and the exhaust muffler such that a guide passage communicated with the guide opening is defined between the exhaust muffler and the muffler protector, the muffler protector having a plurality of air discharge holes communicated with the guide passage and arranged to discharge the cooling air from the guide passage in a first direction away from the working machine; and an insulator separating the carburetor from the second side surface of the cylinder barrel, the insulator including a cover section that covers an open end edge of the fan cover so as to guide the cooling air toward the second side surface of the cylinder barrel, and a deflector section bent toward the carburetor for guiding the cooling air, which has been guided along the second side surface of the cylinder barrel, in a second direction away from the working machine.

With this arrangement, a part of the cooling air fed by the cooling fan toward the exhaust muffler is allowed to pass through the guide opening formed in the fan cover. Since the guide opening is covered by the muffler protector, which also covers the muffler protector, a guide passage communicated with the guide opening is defined between the exhaust muffler and the muffler protector. The muffler protector has the air discharge holes from which the cooling air, which has been introduced in the guide passage, is discharged in a direction away from the working machine.

Furthermore, the carburetor is separated from the second side surface of the cylinder barrel by the insulator. The cover section of the insulator covers the open end edge of the fan cover so as to guide the cooling air toward the second side surface of the cylinder barrel. The deflector section of the insulator, which is bent toward the carburetor, serves to guide the cooling air in a direction away from the working machine.

That part of the cooling air, which has been introduced into the guide passage between the exhaust muffler and the muffler protector, is discharged from the air discharge holes in a direction away from the working machine. On the other hand, that part of the cooling air, which has been guided along the second side surface of the cylinder barrel, is guided by the deflector section in a direction away from the working machine. The cooling air discharged from the air-cooled engine is not reflected by the working machine back toward the air-cooled engine, so that the air-cooled engine can properly suppress temperature rise of the cylinder barrel, exhaust muffler and carburetor.

Preferably, the open end edge of the fan cover has an outwardly swelled part that forms the guide opening of the fan cover. The guide opening formed by the outwardly swelled part of the open end edge is advantageous because it does not deteriorate the stiffness of the fan cover.

The air discharge holes of the muffler protector have an oblong shape and are formed at intervals in a vertical direction. The air discharge holes may be arranged to discharge the cooling air either in a lateral outward direction of the muffler protector which is perpendicular to the first side surface of the cylinder barrel, or in a direction obliquely outward from the muffler protector.

Preferably, the air discharge holes of the muffler protector comprise a plurality of first air discharge holes of oblong shape formed at intervals in a vertical direction and arranged to discharge the cooling air in a lateral outward direction of the muffler protector which is perpendicular to the first side wall of the cylinder barrel, and a plurality of second air discharge holes of oblong shape formed at regular intervals in the vertical direction and disposed downstream of the first air discharge holes as viewed from a direction of flow of the cooling air along the guide passage, the second air discharge holes being arranged to discharge the cooling air in a direction obliquely outward from the muffler protector.

Preferably, the insulator includes an insulator body configured to face the second side surface of the cylinder barrel over the entire area thereof. With the insulator body thus configured, the carburetor can effectively insulated from heat emitted from the cylinder barrel.

DETAILED DESCRIPTION OF THE PREFERRED EMBODIMENT

Figure 1:
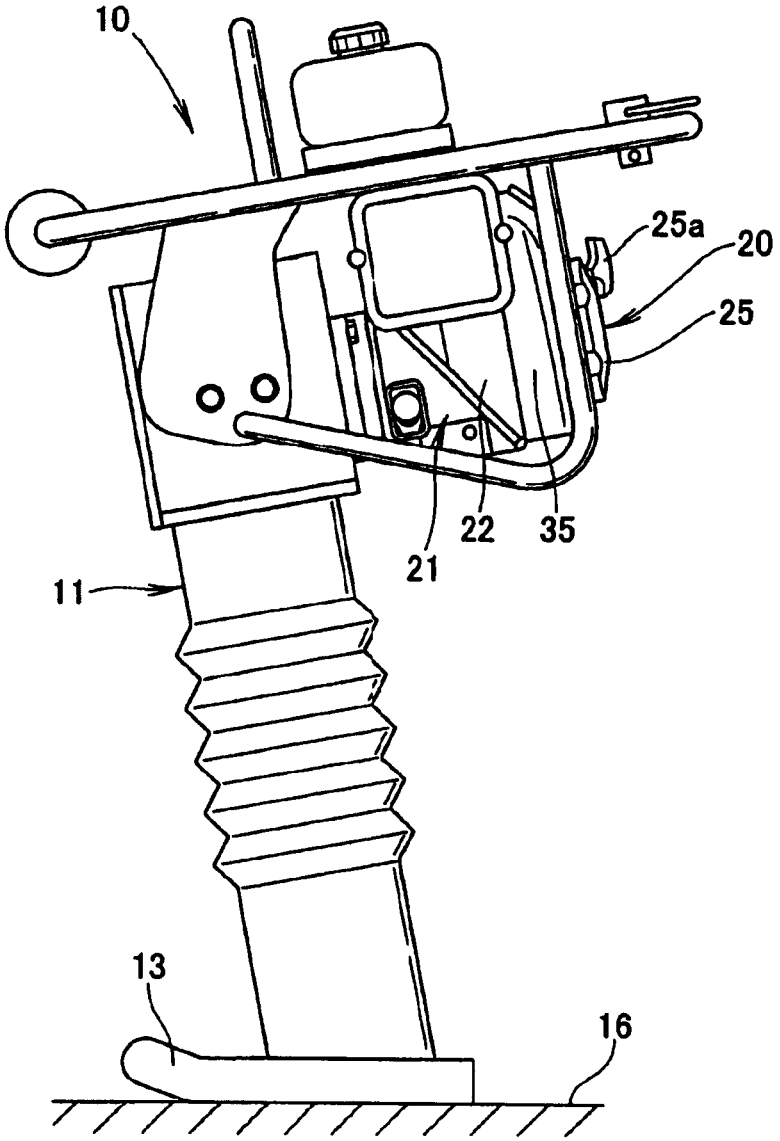
FIG. 1 is a side view of a rammer unit including a rammer device as a working machine to which an air-cooled engine according to one embodiment is mounted.

One preferred structural embodiment of the present invention will be described in detail herein below, by way of example only, with reference to the accompanying sheets of drawings, in which a side on which a recoil starter 25 of an air-cooled engine 20 is located is referred to as a "front side (Fr)", a side on which a rammer device 11 is located is referred to as a "rear side (Rr)", a side on which a carburetor 29 of the air-cooled engine 20 is located is referred to as a "left side (L)", and a side on which an exhaust muffler 27 of the air-cooled engine 20 is located is referred to as a "right side (R)".

As shown in FIG. 1, a rammer unit 10 is comprised of a rammer device (working machine) 11 that is configured to level a ground surface 16, and an air-cooled engine 20 mounted to an upper part of the rammer device 11. The rammer device 11 has an operating mechanism connected in driven relation to one end of a crankshaft CS (FIG. 5) of the air-cooled engine 20. While the air-cooled engine 20 is running, the operating mechanism of the rammer device 11 is drivable to cause a leveling plate 13 to undergo stamping movement to thereby level the ground surface 16.

Figure 2:
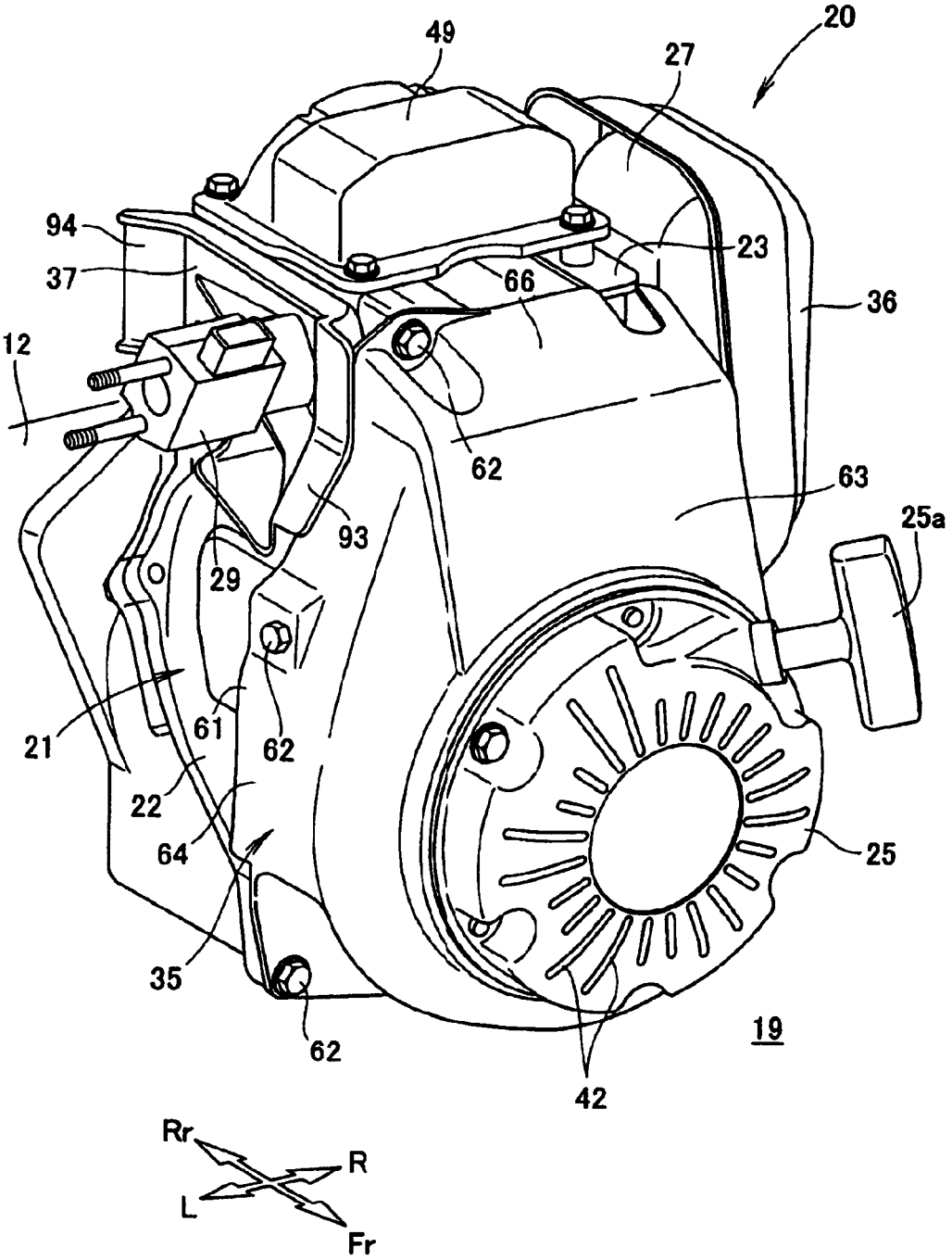
FIG. 2 is a perspective view of the air-cooled engine shown in FIG. 1.
Figure 3:
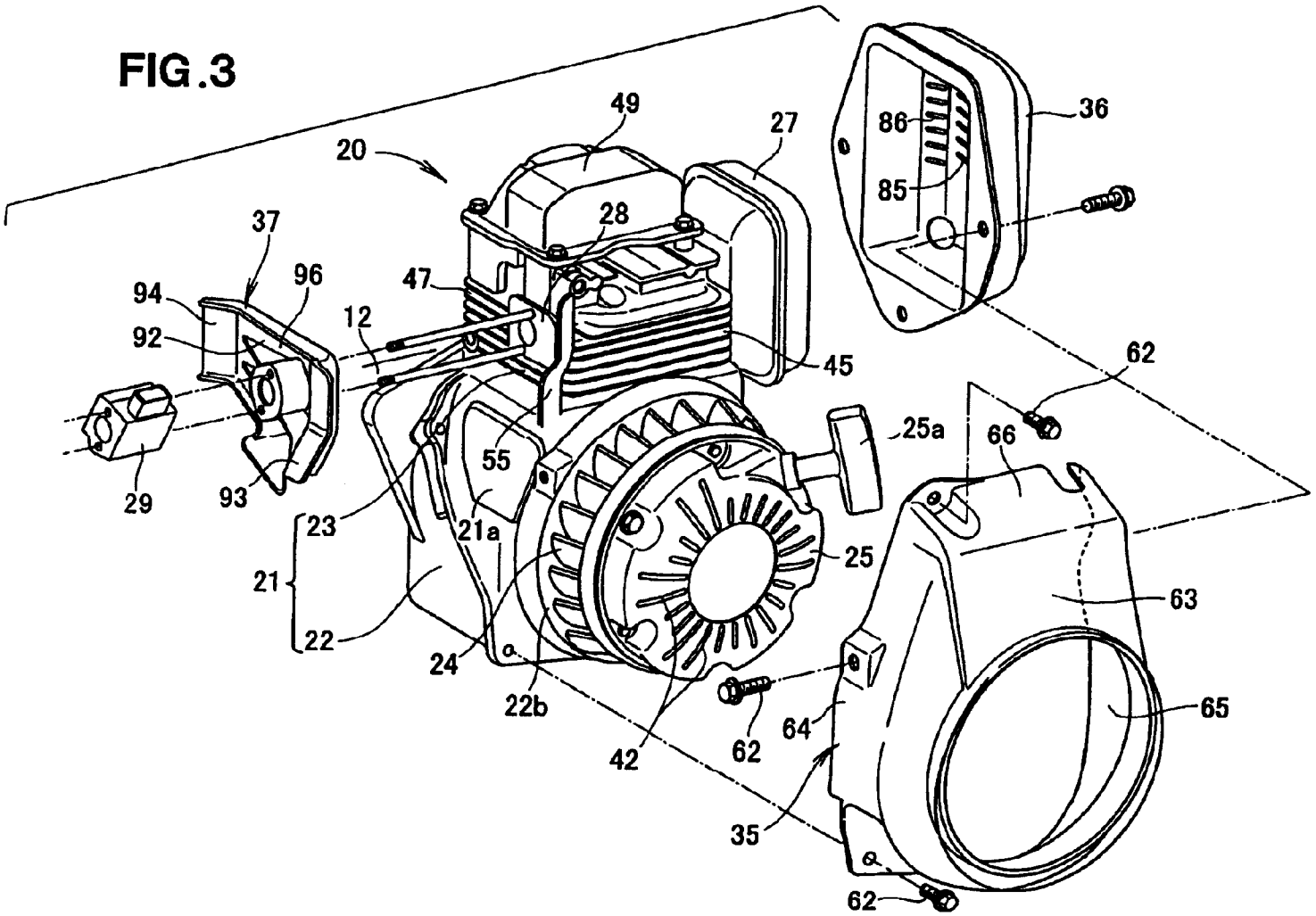
FIG. 3 is an exploded perspective view of the air-cooled engine shown in FIG. 2.

As shown in FIGS. 2 and 3, the air-cooled engine 20 includes an engine case 21 adapted to be attached to the rammer device 11 (FIG. 1), a cooling fan 24 connected in driven relation to an opposite end of the crankshaft CS (FIG. 5) projecting outward from the engine case 21, a recoil starter 25 removably connected to the cooling fan 24, an exhaust muffler 27 connected in fluid communication with an exhaust port 26 (FIG. 4) of the engine case 21, and a carburetor 29 connected in fluid communication with an intake port 28 of the engine case 21.

The air-cooled engine 20 also includes a fan cover 35 provided on a front side of the engine case 21 and configured to cover the cooling fan 24, a muffler protector 36 disposed on a right side of the fan cover 35 and configured to cover the exhaust muffler 27, and an insulator 37 disposed on a left side of the fan cover 35 and configured to separate the carburetor 29 from the engine case 21.

In assembly of the air-cooled engine 20, the cooling fan 24, the recoil starter 25 and the fan cover 35 are assembled to the engine case 21 in the named order. In FIG. 3, in order to facilitate understanding of the structure, only the fan cover 35 is detached from the engine case 21 while the cooling fan 24 and the recoil starter 25 remain in an assembled state.

While the cooling fan 24 is rotating, air is drawn, as a cooling air, from the outside 19 through intake openings 42 of the recoil starter 25 into the fan cover 35. The cooling air introduced into the fan cover 35 is guided via the fan cover 35 toward the muffler protector 36 and the insulator 37.

The engine case 21 is comprised of a crankcase 22 adapted to be attached to a support bracket 12 of the rammer device 11, and a cylinder barrel (cylinder block) 23 provided on and formed integrally with an upper part of the crankcase 22. The crankcase 22 is attached by a plurality of bolts to the support bracket 12 of the rammer device 11 (FIG. 1) at a portion of a rear surface surrounding an output shaft take-out portion. The crankcase 22 has a front surface (a portion opposite to the working machine) 22*b* on which the cooling fan 22 is disposed.

Figure 4:
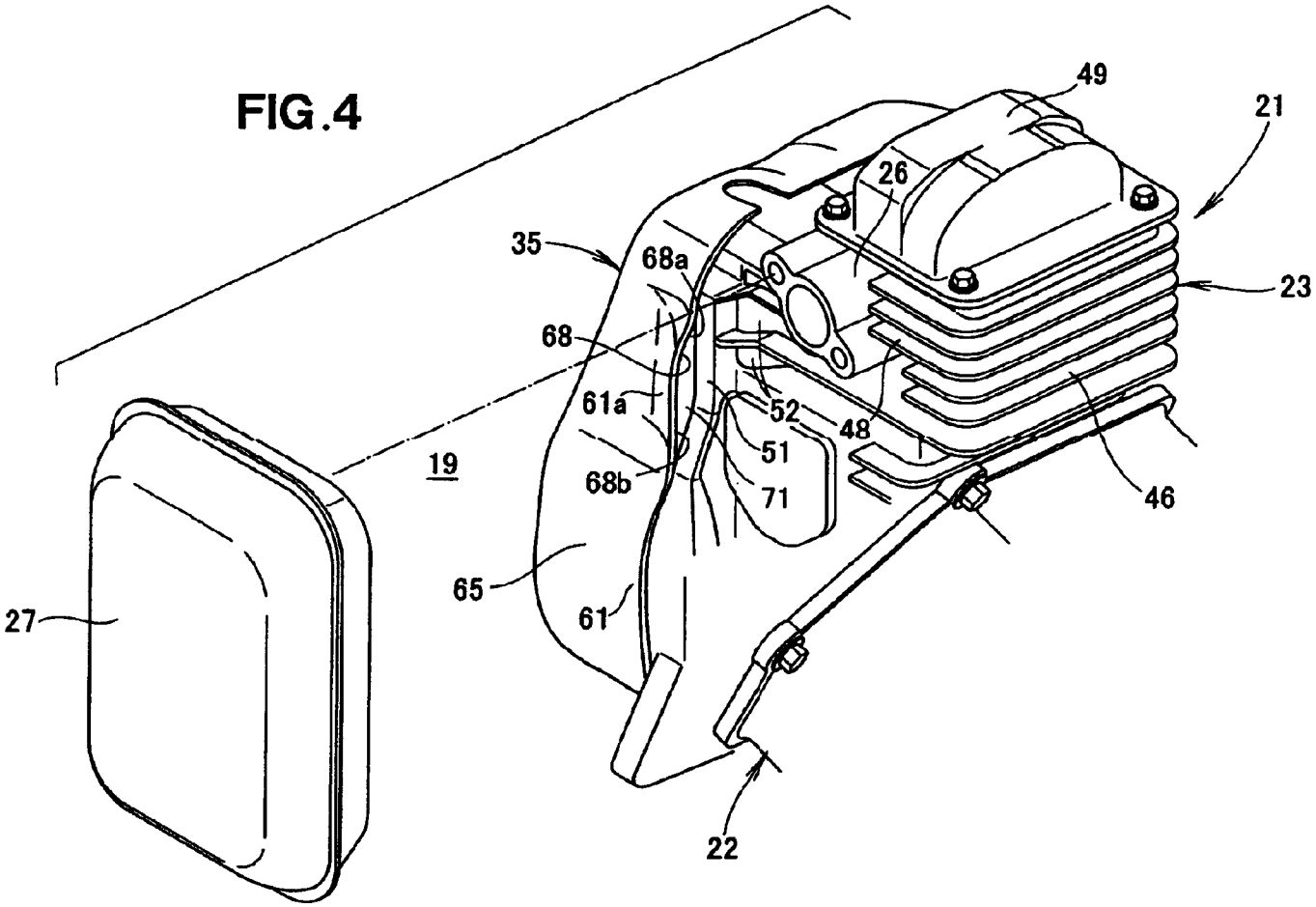
FIG. 4 is a perspective view of the air-cooled engine with parts detached for showing a second guide passage.
Figure 5:
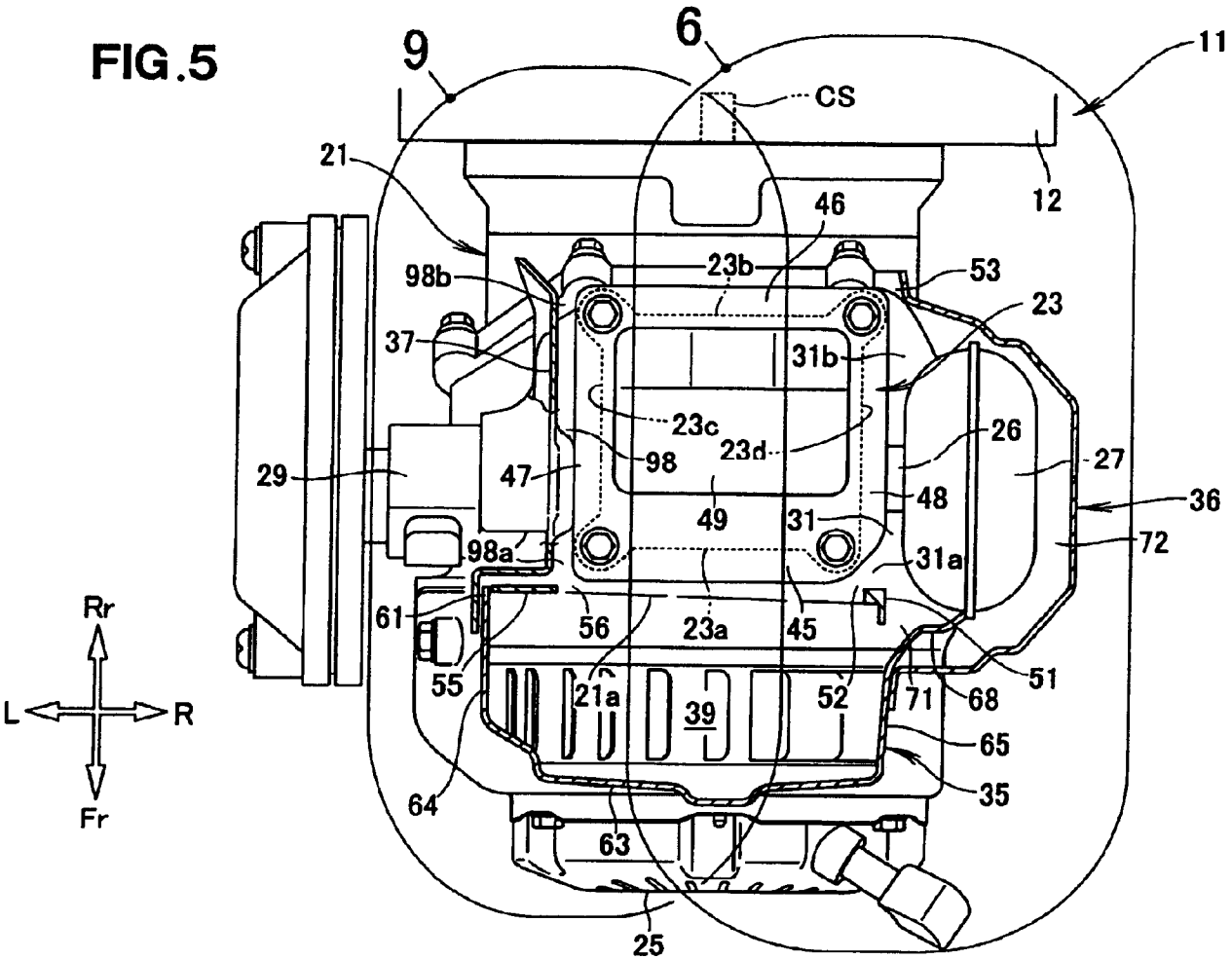
FIG. 5 is a cross-sectional view of the air-cooled engine.

As shown in FIGS. 4 and 5, the cylinder barrel 23 has a plurality of front fins 45 (also refer to FIG. 3) projecting from a front surface 23*a* thereof, a plurality of rear fins 46 projecting from a rear surface 23*b* thereof, a plurality of left fins 47 projecting from a left side surface (second surface) 23*c* thereof, the intake port 28 formed in the left side surface 23*c*, a plurality of right fins 48 projecting from a right side surface (first surface) 23*d* thereof, and the exhaust port 26 formed in the right side surface 23*d*. A barrel head 49 is provided on an upper end of the cylinder barrel 23.

The exhaust port 26 is provided on the right side surface 23*d* of the cylinder barrel 23 and the exhaust muffler 27 is attached to the exhaust port 26. In this instance, the exhaust muffler 27 is provided to face the right fins 48 at a predetermined interval in a right-and-left direction relative to the right side surface 23*d* of the cylinder barrel 23, so that a first guide passage 31 is formed between the exhaust muffler 27 and the right side surface 23*d* of the cylinder barrel 23.

A right block 51 is provided on the right side surface 23*d* of the cylinder block 23 in such a manner that a right front opening 52 is formed between the right block 51 and the cylinder barrel 23. The right front opening 52 communicates an internal space 39 of the fan cover 35 with a front part 31*a* of the first guide passage 31.

A rear part 31*b* of the first guide passage 31 communicates with a right rear opening 53. The right rear opening 53 is provided to face the support bracket 12 of the rammer device 11 at a predetermined interval in a front-and-rear direction relative to the support bracket 12.

Furthermore, the intake port 28 is provided on the left side surface 23*c* of the cylinder barrel 23, and the carburetor 29 is attached to the intake port 28 via the insulator 37. With this arrangement, the carburetor 29 is separated from the left side surface 23*c* of the cylinder barrel 23 by means of the insulator 37 (also refer to FIG. 1). By thus separating the carburetor 29 from the cylinder barrel 23 (more particularly, the left side surface 23*c* thereof) using the insulator 37, it is possible to insulate heat from the cylinder barrel 23 after the engine 20 is stopped. Thus, the carburetor 29 is protected from a hot soak problem.

A left block 55 (also refer to FIG. 8) is provided on the left side surface 23*c* of the cylinder barrel 23 in such a manner that a left front opening 56 is formed between the left block 55 and the cylinder barrel 23. The left front opening 56 communicates the internal space 39 of the fan cover 35 with a front part 98*a* of a fourth guide passage 98. A front part 98*b* of the fourth guide passage 98 is provided to face the support bracket 12 of the rammer device 11 with a predetermined space defined in the front-and-rear direction relative to the support bracket 12.

The fan cover 35 is attached to a front part 21*a* of the engine case 21 by a plurality of bolts 62 (FIG. 2). The fan cave 35 has an open end edge 61 configured to cover the front part 21 of the engine case 21. The open end edge 61 of the fan cover 35 defines an open end of the fan cover 35. The cooling fan 24 and the cylinder barrel 23 (more particularly, the plurality of front fins 45) are covered by the fan cover 35.

As shown in FIGS. 2 and 5, the fan cover 35 includes a front wall 63 located on a front side of the cooling fan 24 and the cylinder barrel 23 (more particularly, the front fins 45 thereof), a left side wall 64 bent from a left side edge of the front wall 63 toward the carburetor 29, a right side wall 65 (FIG. 3) bent from a right side edge of the front wall 63 toward the exhaust muffler 27, and an upper wall 66 bent from an upper edge of the front wall 63 toward the barrel head 49.

Figure 6:
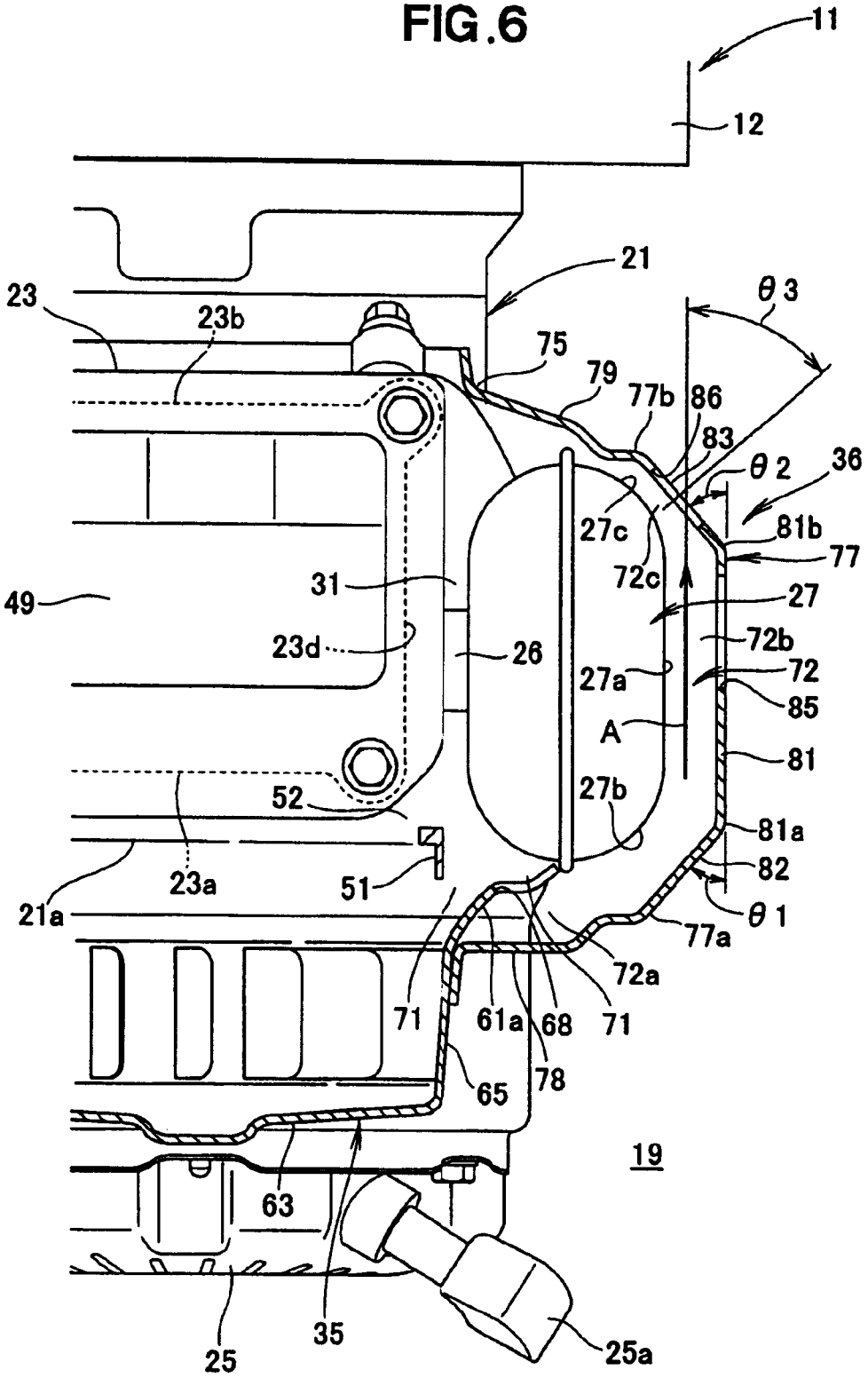
FIG. 6 is an enlarged view of a part 6 shown in FIG. 5.

As shown in FIGS. 4 and 6, the fan cover 35 also has a guide opening 68 located at a right upper part 61*a* of the right side wall 65 that forms a part of the open end edge 61 of the fan cover 35. The right upper part 61*a* of the right side wall 65 is bulged or swelled toward the outside 19 so that the guide opening 68 is in the form of a recessed portion.

With the fan cover 35 being attached to the front part 21*a* of the engine case 21, the guide opening 68 is located on a right side of the right side wall 23*d* of the cylinder barrel 23 while an upper end 68*a* and a lower end 68*b* of the recess-shaped guide opening 68 are in contact with the right block 51. Thus, the right block 51 and the guide opening (recessed portion) 68 together form a second guide passage 71.

The second guide passage 71 is provided to communicate the internal space 39 of the fan cover 35 with a third guide passage 72 formed inside the muffler protector 36. The guide opening 68 may be formed by cutting-away or removing the material of the right upper part 61*a* of the right side wall 65 located adjacent to the open end edge 61. However, the guide opening (recessed portion) 68 formed by swelling or bulging the right upper part 61*a* of the right side wall 65 is preferable because the fan cover 35 can retain a desired degree of stiffness.

Referring back to FIG. 3, the cooling fan 24 and the front fins 45 of the engine barrel 23 are covered by the fan cover 35. With this arrangement, the cooling air drawn into the fan cover 35 is fed upwardly by the cooling fan 24. The cooling air thus fed by the cooling fan 24 is guided onto the font fins 45 where the cooling air is guided by the front fins 45 to flow in a branched or bifurcated manner toward the exhaust muffler 27 and the carburetor 29. That part of the cooling air which has been guided toward the exhaust muffler 27 passes through the right front opening 52 and advances along the first guide passage 31, and while at the same time, the cooling air part passes through the second guide passage 71 and is guided into the third guide passage 72, as shown in FIG. 6.

Figure 7:
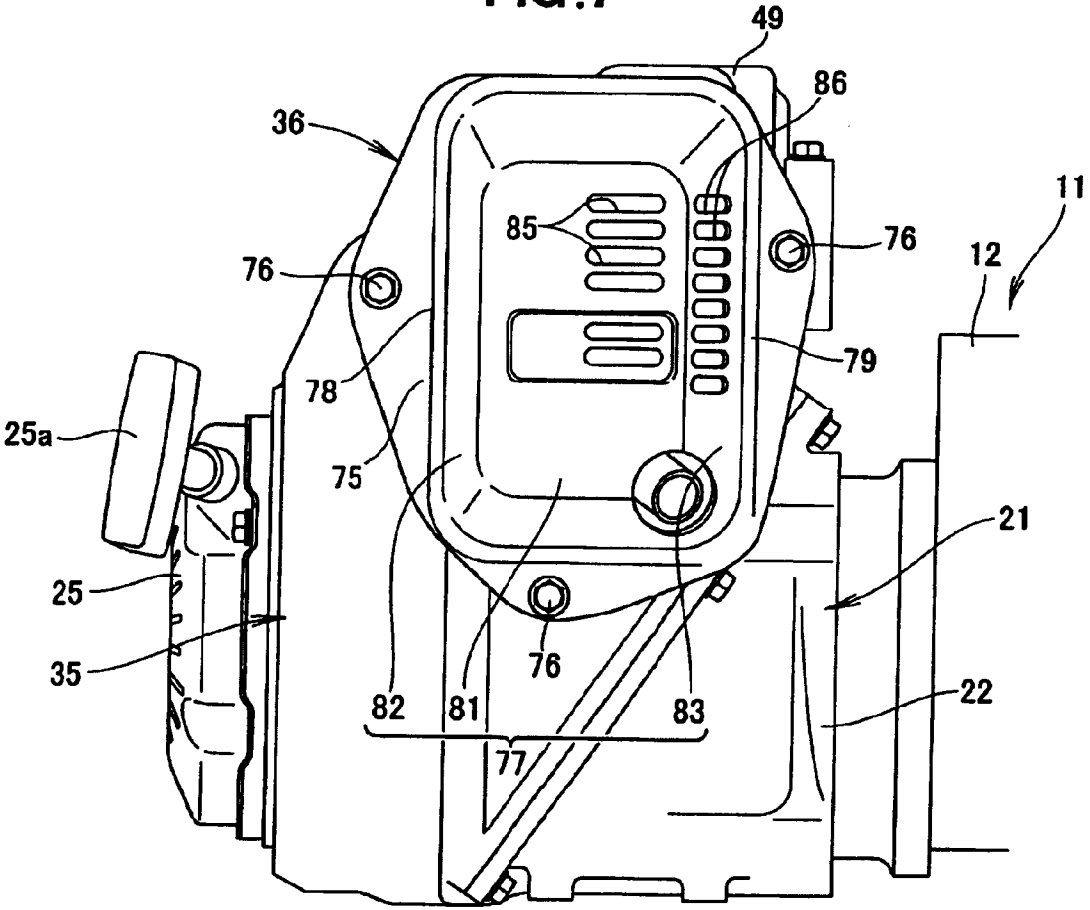
FIG. 7 is a side view of the air-cooled engine.

As shown in FIGS. 6 and 7, the muffler protector 36 is attached to the right side surface 23*d* of the cylinder barrel 23 by a plurality of bolts 76, with an open end edge 75 of the muffler protector 36 disposed on the right side surface 23*d* of the cylinder barrel 23. The muffler protector 36 is disposed on a right side of the fan cover 35, and the exhaust muffler 27 is covered by the muffler protector 36.

The muffler protector 36 includes a right side wall 77 disposed on a right side of the exhaust muffler 27, a front wall 78 bent from a front side edge 77*a* of the right side wall 77 toward the cooling fan 24, and a rear wall 79 bent from a rear side edge 77*b* of the right side wall 77 toward the cylinder barrel 23

The front wall 78 of the muffler protector 36 is disposed forwardly of the second guide passage 71 and separated from the exhaust muffler 27 in the front-and-rear direction by a predetermined distance. The right side wall 77 of the muffler protector 36 is disposed on a right side of the exhaust muffler 27 and separated from the exhaust muffler 27 in the right-and-left direction by a predetermined distance.

The right side wall 77 of the muffler protector 36 has a substantially rectangular flat central web portion 81 extending substantially parallel to an outer side wall 27*a* of the exhaust muffler 27, a front inclined wall portion 82 extending from a front side edge 81*a* of the rectangular central web portion 81 to the front side edge 77*a* of the right side wall 77, and a rear inclined wall portion 83 extending from a rear side edge 81*b* of the rectangular central web portion 81 to the rear side edge of the right side wall 77.

The rectangular central web portion 81 of the right side wall 77 is spaced a predetermined distance from the outer side wall 27*a* of the exhaust muffler 27. The rectangular central web portion 81 has a plurality of first air discharge holes 85 of oblong shape formed at substantially regular intervals in a vertical direction.

The front inclined wall portion 82 of the right side wall 77 is inclined at an angle θ1 relative to the central web portion 81 and extends along a front part 27*b* of the exhaust muffler 27 such that the front inclined wall portion 82 is spaced a predetermined distance from the front part 27*b* of the exhaust muffler 27. The front inclined wall portion 82 and the front wall 78 of the muffler protector 36 cover the second guide passage 71 from the front side of the engine 20.

The rear inclined wall portion 83 is inclined at an angle θ2 relative to the central web portion 81 and extends along a rear part 27*c* of the exhaust muffler 27 such that the rear inclined wall portion 83 is spaced from the rear part 27*c* of the exhaust muffler 27 by a predetermined distance. The rear inclined wall portion 83 has a plurality of second air discharge holes 86 of oblong shape formed at regular intervals in the vertical direction.

The rear wall 39 of the muffler protector 36 is disposed rearwardly of the exhaust muffler 27 and separated from the exhaust muffler 27 by a predetermined distance.

The exhaust muffler 27 is covered by the muffler protector 36 (including the front wall 78, right side wall 77 and rear wall 79). With the exhaust muffler 27 being covered by the muffler protector 36, the third guide passage 72 is formed between the muffler protector 36 and the exhaust muffler 27. The third guide passage 72 has a front part 72*a* communicating with the second guide passage 71, an intermediate part 72*b* communicating with the first air discharge holes 85, and a rear part 72*c* communicating with the second air discharge holes 86. The second air discharge holes 86 are disposed downstream of the first air discharge holes 85 as viewed from a direction of flow of the cooling air along the third guide passage 72.

The first air discharge holes 85 are arranged to open in a direction which is perpendicular to a cooling-air-guiding direction (indicated by the arrow A) of the third guide passage 72 and which is parallel to the support bracket 12 of the rammer device 11. The second air discharge holes 86 are arranged to open in a direction inclined at an angle θ3 relative to the cooling-air-guiding direction (indicated by the arrow A) of the third guide passage 72. The second air discharge holes 86 are oriented to face in a direction deflected in a lateral outward direction (rightward direction in FIG. 6) of the support bracket 12 of the rammer device 11. With this arrangement, the cooling air guided in the third guide passage 72 is discharged from the first and second air discharge holes 85, 82 in directions laterally outwardly away from the support bracket 12 of the rammer device 11.

Figure 8:
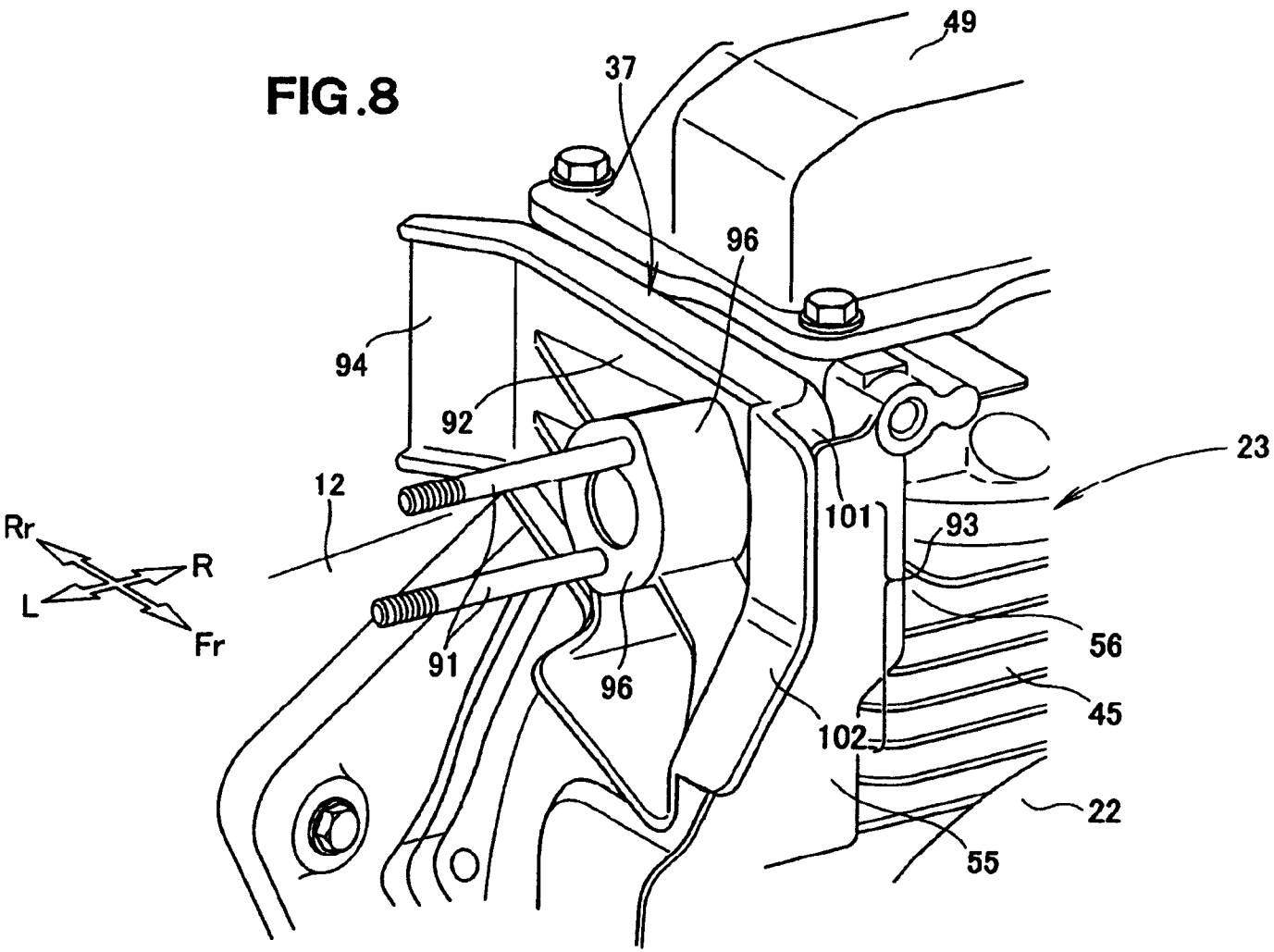
FIG. 8 is a perspective view showing an insulator of the air-cooled engine.
Figure 9:
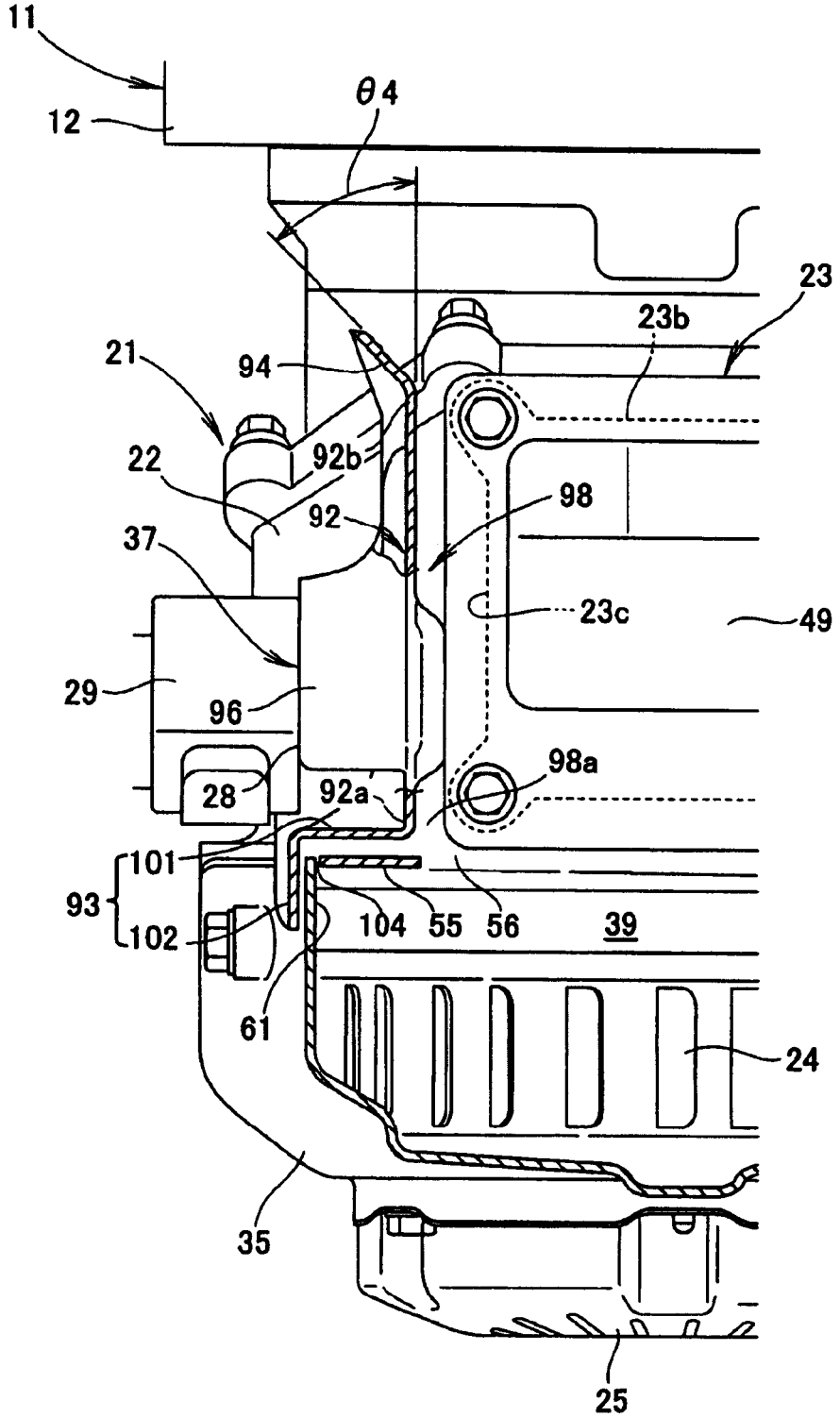
FIG. 9 is an enlarged view of a part 9 shown in FIG. 5.

As shown in FIGS. 8 and 9, the insulator 37 is attached to the intake port 28 (on the left side surface 23*c*) of the cylinder barrel 23 by a pair of stud bolts 91. The insulator 37 includes an insulator body 92 attached to the intake port 28, a generally L-shaped cover section 93 provided at a front side edge 92*a* of the insulator body 92, and a deflector section 94 provided at a rear side edge 92*b* of the insulator body 92.

The insulator body 92 includes a cylindrical connecting section 96 directly connected to the intake port 28. The connecting portion 96 and the carburetor 29 are attached to the intake port 28 by means of the stud bolts 91 with the connecting portion 96 interposed between the carburetor 29 and the intake port 28. The insulator body 92 is separated in the right-and-left direction from the left side surface 23*c* of the cylinder barrel 23 by a predetermined distance. Thus, the carburetor 29 is separated from the left side surface 23*c* of the cylinder barrel 23 by the insulator body 92.

Since the insulator body 92 is separated from the left side surface 23*c* of the cylinder barrel 23 by the predetermined distance, the fourth guide passage 98 is formed between the insulator body 92 and the left side surface 23*c* of the cylinder barrel 23. The front part 98*a* of the fourth guide passage 98 communicates with the internal space 39 of the fan cover 35 through the left front opening 56. The left front opening 56 is formed between the left block 55 and the cylinder barrel 23. The cooling air is guided into the front part 98*a* of the fourth guide passage 98 via the left front opening 56. The insulator body 92 is configured to have a size which is large enough to face the entire area of the left side surface 23*c* of the cylinder barrel 23. The fourth guide passage 98 is therefore allowed to have a longer cooling length, which will ensure that the cooling air can cool the left side surface 23*c* of the cylinder barrel 23 for a longer period of time.

The cover section 93 has an L-shape in horizontal cross section and includes a first wall 101 extending from the front side edge 92*a* of the insulator body 92 in a direction away from the left side wall 23*c* of the cylinder barrel 23, and a second wall 102 extending from a distal end edge of the first wall 101 in a forward direction of the air-cooled engine 10.

The first wall 101 of the L-shaped cover section 93 extends along the left block 55 and the second wall 102 extends along the open end edge 61 of the fan cover 35 such that the open end edge 61 of the fan cover 35 and a space 104 between the open end edge 61 of the fan cover 35 and the left block 55 is covered by the L-shaped cover section 93. With this arrangement, the cooling air which has been guided toward the carburetor 29 is properly guided through the left front opening 56 into the fourth guide passage 98 (extending along the left side surface 23*c* of the cylinder barrel 23).

The deflector section 94 of the insulator 37 is bent at an angle θ4 (FIG. 9) to the insulator body 92 and extends obliquely from the rear end edge 92*b* of the insulator body 92 in a direction deflected in a lateral outward direction (leftward direction of FIG. 9) of the support bracket 12 of the rammer device 11. The deflector section 94 projects in the rearward direction beyond the rear surface 23*b* of the cylinder barrel 23. With the deflector section 94 extending obliquely in a lateral outward direction (leftward direction in FIG. 9) of the support bracket 12 of the rammer device 11, the cooling air having passed through the fourth guide passage 98 is guided by the deflector section 94 to flow in a direction laterally outward from the support bracket 12 of the rammer device 11.

Figure 10A:
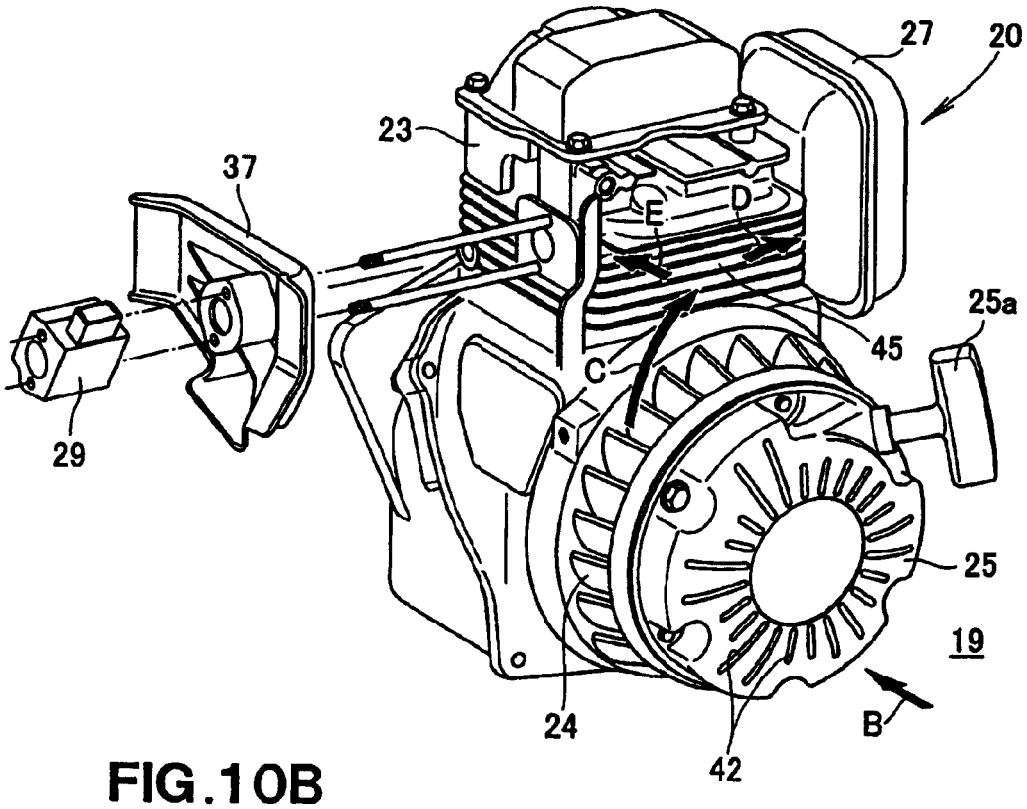
FIGS. 10A and 10B are views illustrative of the manner in which a cooling air is guided toward an exhaust muffler and a carburetor of the air-cooled engine.

Referring next to FIGS. 10A to 12B, a description will be made about the manner in which a cooling air cools the air-cooled engine 20. As shown in FIG. 10A, a knob 25*a* of the recoil starter 25 is pulled to start the air-cooled engine 20 whereupon the cooling fan 24 connected to the crankshaft CS (FIG. 5) of the engine 20 is driven to rotate. Rotation of the cooling fan 24 causes air to be drawn from the outside 19 through the intake openings 42 of the recoil starter 25 into the cooling fan 24 as a cooling air, as indicated by the arrow B.

The cooling air drawn into the cooling fan 24 is fed by the cooling fan 24 into the internal space 39 (FIG. 10B) of the fan cover 35, as indicated by the arrow C. The cooling air fed from the cooling fan 24 is guided to flow along the front fins 45 in a branched or bifurcated manner partly toward the exhaust muffler 27 as indicated by the arrow D, and partly toward the carburetor 29 as indicated by the arrow E.

Figure 10B:
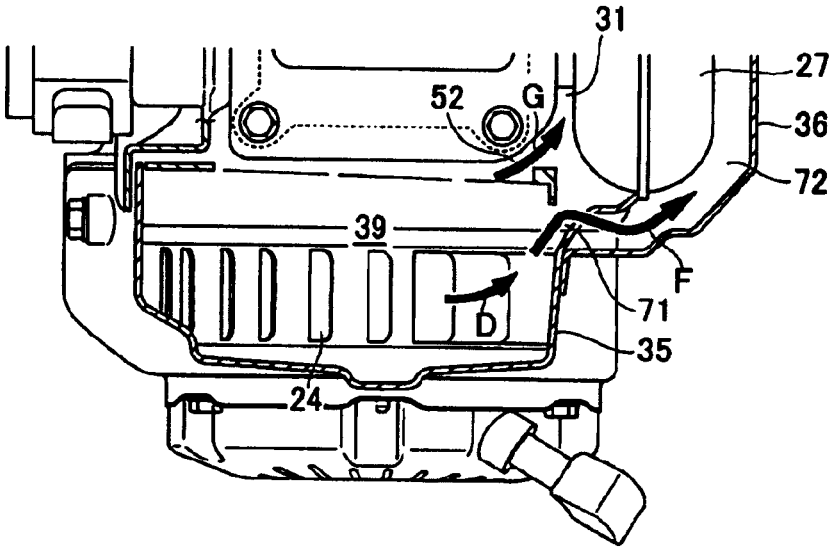

As shown in FIG. 10B, a part of the cooling air, which has been guided toward the exhaust muffler 27, is guided through the second guide passage 71 into the third guide passage 72, as indicated by the arrow F. Concurrently therewith, the rest of the cooling air, which has been guided toward the exhaust muffler 27, is guided through the right front opening 52 into the first guide passage 31, as indicated by the arrow G. By virtue of the cooling air guided into the third guide passage 72 as indicated by the arrow F in combination with the cooling air guided into the first guide passage 31 as indicated by the arrow G, temperature rise of the exhaust muffler 27 can be efficiently suppressed.

The second guide passage 71 is arrange to open in a direction directly opposite to a direction of flow of the cooling air (indicated by the arrow D) so that the cooling air guided toward the exhaust muffler 27 as indicated by the arrow D can be smoothly introduced into the second guide passage 71 as indicated by the arrow F.

Figure 11A:
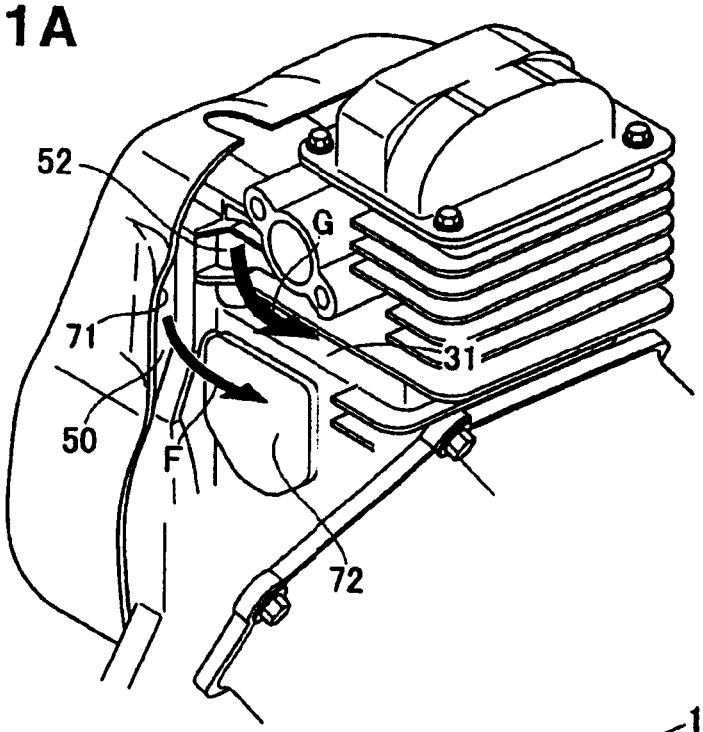
FIGS. 11A and 11B are views illustrative of the manner in which temperature rise of the exhaust muffler is suppressed.

As shown in FIG. 11A, smooth guidance of the cooling air into the second guide passage 71 as indicated by the arrow F makes it possible to increase the amount of cooling air to be introduced into the third guide passage 72 as indicated by the arrow F. On the other hand, the amount of cooling air guided into the right front opening 52 is relatively small and, hence, a relatively small amount of cooling air is introduced into the first guide passage 31 as indicated by the arrow G.

Figure 11B:
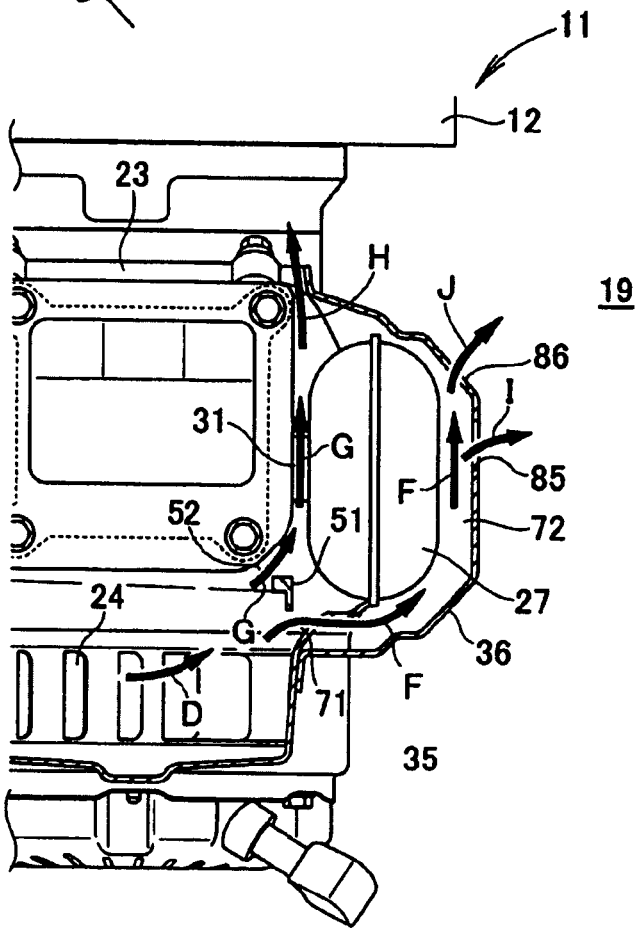

As shown in FIG. 11B, the relatively small amount of cooling air, which has been introduced into the first guide passage 31, passes through the first guide passage 31 and then is discharged into a space between the support bracket 12 of the rammer device 11 and the rear surface 23*b* of the cylinder barrel 23, as indicated by the arrow H. On the other hand, the relatively large amount of cooling air, which has been introduced into the third guide passage 72, passes through the third guide passage 72 and then is discharged from the first air discharge holes 85 to the outside 19 as indicated by the arrow I and also from the second air discharge holes 86 to the outside 19 as indicated by the arrow J.

The first air discharge holes 58 are arranged to open in a direction which is substantially perpendicular to the cooling-air-guiding direction of the third guide passage 72 and which is substantially parallel to the plane of the support bracket 12 of the rammer device 11. With this arrangement, a relatively small part of the cooling air having been introduced into the third guide passage 72 is discharged from the first air discharge holes 85 in a direction laterally outwardly away from the support bracket 12 of the rammer device 11, as indicated by the arrow I. The cooling air discharged from the first air discharge holes 85 can never return to the air-cooled engine 20.

The second air discharge holes 83 are arranged to open in a direction, which is inclined at the angle θ3 (FIG. 6) to the cooling-air-guiding direction of the third guide passage 72, and which is deflected in a lateral outward direction (rightward direction) of the support bracket 12 of the rammer device 11. With this arrangement, a relatively large part of the cooling air having been introduced into the third guide passage 72 is discharged from the second air discharge holes 86 in a direction laterally outwardly away from the support bracket 12 of the rammer device 11. The cooling air thus discharged from the second air discharge holes 86 can never return to the air-cooled engine 20.

Figure 12A:
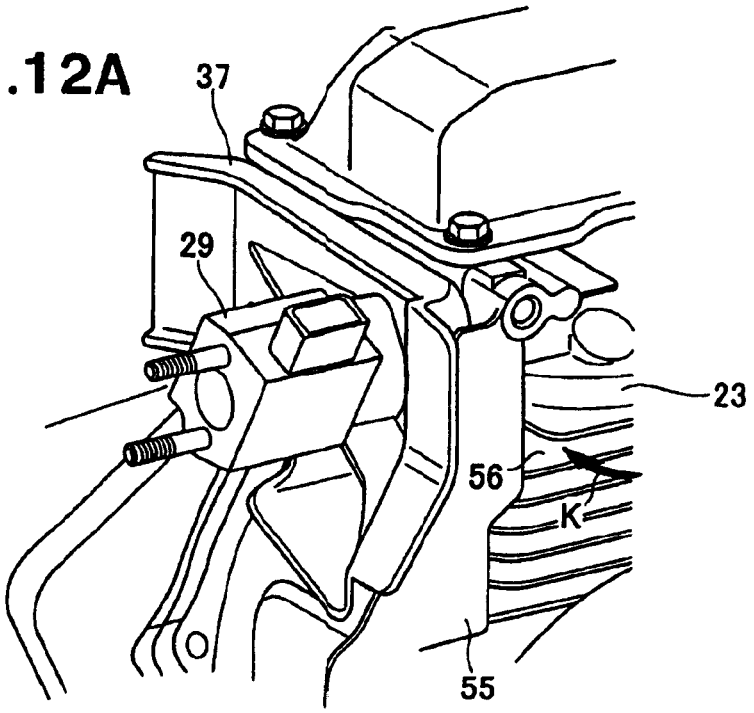
FIGS. 12A and 12B are views illustrative of the manner in which temperature rise of the carburetor is suppressed.

As shown in FIG. 12A, the cooling air guided toward the carburetor 29 is introduced through the left front opening 56 into the fourth guide passage (FIG. 12B) as indicated by the arrow K.

Figure 12B:
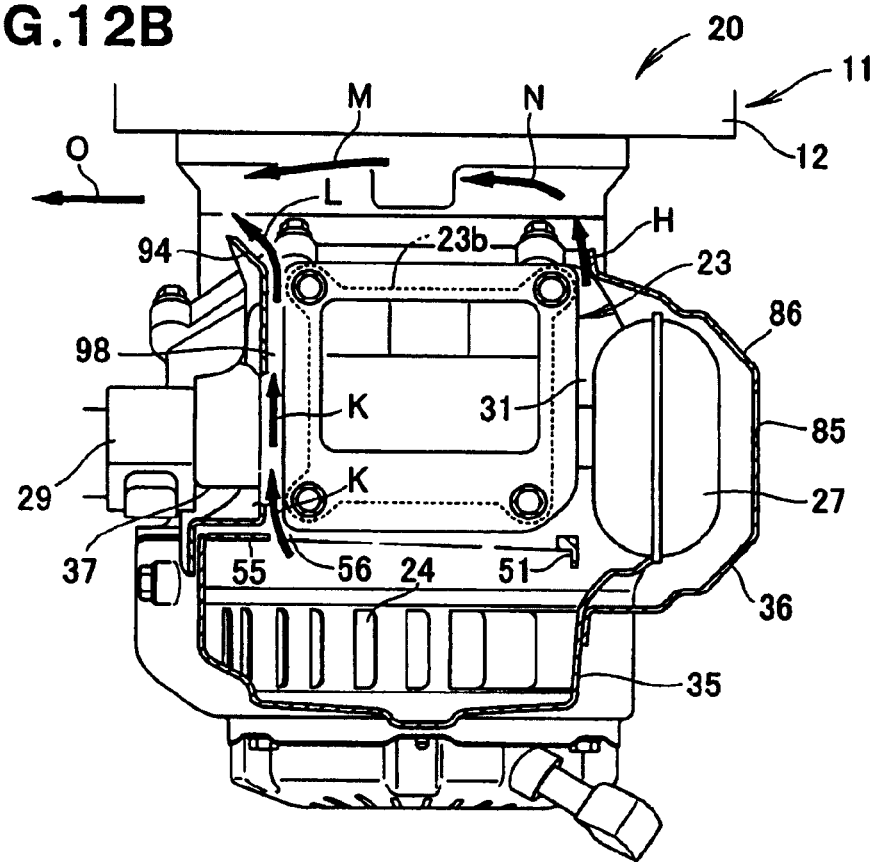

As shown in FIG. 12B, the cooling air thus introduced into the fourth guide passage 98 flows downstream along the fourth guide passage 98 during which time the left side surface 23*c* of the cylinder barrel 23 is cooled by the cooling air. Temperature rise of the left side surface 23*c* of the cylinder barrel 23 and the carburetor 29 can thus be suppressed. Furthermore, the carburetor 29 is separated from the fourth guide passage 98 by the insulator 37. The insulator 37 insulates the carburetor 29 from the effect of heat emitted from the cylinder barrel 23 and heat from the cooling air that has been used for cooling the cylinder barrel 23.

At a downstream end of the fourth guide passage 98, the cooling air is deflected by the deflector section 94 of the insulator 37 in a lateral outward direction (leftward direction of FIG. 12B) of the support bracket 12 of the rammer device 11, as indicated by the arrow L. By thus deflecting the cooling air as it is discharged from the fourth guide passage 98, it is possible to prevent the cooling air from flowing back to the air-cooled engine 20. By the action of the cooling air discharged from the fourth guide passage 98 as indicated by the arrow L, air in a space between the support bracket 12 of the rammer device 11 and the rear surface 23*b* of the cylinder barrel 23 is drawn in a direction as indicated by the arrow M.

By the action of the air drawn in the direction of the arrow M, the cooling air, which has been discharged from the first guide passage 31 into a space between the support bracket 12 of the rammer device 11 and the rear surface 23*b* of the cylinder barrel 23 as indicated by the arrow H, is guided to flow between the support bracket 12 of the rammer device 11 and the rear surface 23*b* of the cylinder barrel 23 as indicated by the arrow N.

The cooling air guided along the deflector section 94 of the insulator 37 and the cooling air guided in the direction of the arrow N merge together and then a combined flow of cooling air is guided in a lateral outward direction (leftward direction in FIG. 12B) of the support bracket 12 of the rammer device 11, as indicated by the arrow O. The deflector section 94 serves to prevent the cooling air from turning toward the carburetor 29, and temperature rise of the carburetor 29 can be suppressed.

The amount of cooling air, which is discharged from the first guide passage 31 into a space between the support bracket 12 of the rammer device 11 and the rear surface 23*b* of the cylinder barrel 23 as indicated by the arrow H, is relatively small. It is therefore unlikely to occur that the cooling air discharged into the space between the support bracket 12 and the rear surface 23*b* in the direction of the arrow H flows back toward the air-cooled engine as it is drawn in the direction of the arrow N.

As thus far described, the cooling air guided into the third guide passage is discharged from the first air discharge holes 85 and the second air discharge holes 86 in directions laterally outwardly away from the support bracket 12 of the rammer device 11. Furthermore, the cooling air introduced into the fourth guide passage 98 is guided by the deflector section 94 of the insulator 37 in a lateral outward direction of the support bracket 12 of the rammer device 11. Additionally, the cooling air, which is discharged from the first guide passage 31 into the space between the support bracket 12 of the rammer device 11 and the rear surface 23*b* of the cylinder barrel 23 as indicated by the arrow H, is drawn to flow in the direction as indicated by the arrow N.

The cooling air discharged from the air-cooled engine 20 is thus prevented from being reflected by the support bracket 12 of the rammer device 11 back to the air-cooled engine 20. This will ensure that temperature rise of the cylinder barrel 23, exhaust muffler 27 and carburetor 29 can be properly suppressed.

In the illustrated embodiment, the air-cooled engine is used with a rammer device as a working machine. The air-cooled engine can be used with another type of working machine such as a pump, an electric power generator, a tilling machine, or a snow-removing machine. Furthermore, with respect to the rammer unit, rammer device, air-cooled engine, crankcase, cylinder barrel, cooling fan, exhaust muffler, carburetor, fan cover, muffler protector, open end edge of the fan cover, guide opening, third guide passage, second air discharge hole, and deflector section of the insulator, the shape and configuration should by no means be limited to those shown in the illustrated embodiment but may be changed or modified where appropriate.

The present disclosure is particularly suitable for use in an air-cooled engine adapted to be mounted to a working machine and configured to guide a cooling air fed from a cooling fan toward an exhaust muffler and a carburetor.

Obviously, various minor changes and modifications of the present invention are possible in light of the above teaching. It is therefore to be understood that within the scope of the appended claims the invention may be practiced otherwise than as specifically described.

What is claimed is:

1. An air-cooled engine for a working machine, comprising:

a crankshaft having a first end configured to be connected to the working machine, and a second end opposite to the first end;

a cylinder barrel having a first side surface that faces in a direction perpendicular to an axis of the crankshaft, and a second side surface opposite to the first side surface, the cylinder barrel further having an intake port provided on the second side surface thereof;

an exhaust muffler provided on the first side surface of the cylinder barrel;

a carburetor connected in fluid communication with the intake port provided on the second side surface of the cylinder barrel;

a cooling fan connected to the second end of the crankshaft for rotation therewith;

a fan cover that covers the cooling fan in such a manner as to guide a cooling air fed from the cooling fan toward the exhaust muffler and the carburetor in a bifurcated manner, the fan cover having a guide opening for allowing the passage therethrough of a part of the cooling air guided toward the exhaust muffler;

a muffler protector that covers the guide opening of the fan cover and the exhaust muffler such that a guide passage communicated with the guide opening is defined between the exhaust muffler and the muffler protector, the muffler protector having a plurality of air discharge holes communicated with the guide passage and arranged to discharge the cooling air from the guide passage in a first direction away from the working machine; and an insulator interposed between the intake port and the carburetor and separating the carburetor from the second side surface of the cylinder barrel, the insulator including a cover section that covers an open end edge of the fan cover so as to guide the cooling air toward the second side surface of the cylinder barrel, and a deflector section bent toward the carburetor for guiding the cooling air, which has been guided along the second side surface of the cylinder barrel, in a second direction away from the working machine.

2. The air-cooled engine according to claim 1, wherein the open end edge of the fan cover has an outwardly swelled part that forms the guide opening of the fan cover.

3. The air-cooled engine according to claim 1, wherein the plurality of air discharge holes of the muffler protector have an oblong shape and are disposed at intervals in a vertical direction and arranged to discharge the cooling air in a lateral outward direction of the muffler protector which is perpendicular to the first side surface of the cylinder barrel.

4. The air-cooled engine according to claim 1, wherein the plurality of air discharge holes of the muffler protector have an oblong shape and are disposed at regular intervals in a vertical direction and arranged to discharge the cooling air in a direction obliquely outward from the muffler protector.

5. The air-cooled engine according to claim 1, wherein the plurality of air discharge holes of the muffler protector comprise a plurality of first air discharge holes of oblong shape disposed at intervals in a vertical direction and arranged to discharge the cooling air in a lateral outward direction of the muffler protector which is perpendicular to the first side wall of the cylinder barrel, and a plurality of second air discharge holes of oblong shape disposed at regular intervals in the vertical direction and disposed downstream of the first air discharge holes as viewed from a direction of flow of the cooling air along the guide passage, the second air discharge holes being arranged to discharge the cooling air in a direction obliquely outward from the muffler protector.

6. The air-cooled engine according to claim 1, wherein the insulator includes an insulator body configured to face the second side surface of the cylinder barrel over the entire area thereof.

* * * * *